United States Patent [19]

Takemura

[11] 4,405,418

[45] Sep. 20, 1983

[54] PROCESS FOR THE PRODUCTION OF SODIUM CHLORATE

[75] Inventor: Reiji Takemura, Nobeoka, Japan

[73] Assignee: Asahi Kasei Kogyo Kabushiki Kaisha, Osaka, Japan

[21] Appl. No.: 240,226

[22] Filed: Mar. 3, 1981

[30] Foreign Application Priority Data

Mar. 3, 1980 [JP] Japan ..... 55-2533
Nov. 6, 1980 [JP] Japan ..... 55-77858

[51] Int. Cl.[3] ..... C25B 1/34

[52] U.S. Cl. ..... 204/95; 204/232; 204/237; 210/681; 210/687

[58] Field of Search ..... 204/95, 98, 99; 210/681, 687

[56] References Cited

U.S. PATENT DOCUMENTS

| | | | |
|---|---|---|---|
| 3,897,320 | 7/1975 | Cook | 204/95 |
| 4,078,978 | 3/1978 | Zirngiebl | 204/98 |
| 4,119,508 | 10/1978 | Yokota et al. | 204/99 |

FOREIGN PATENT DOCUMENTS

| | | | |
|---|---|---|---|
| 51-086100 | 7/1976 | Japan | 204/98 |
| 52-22092 | 2/1977 | Japan . | |
| 53-21400 | 7/1978 | Japan . | |
| 54-68900 | 6/1979 | Japan . | |
| 54-37079 | 11/1979 | Japan . | |
| 2042565 | 9/1980 | United Kingdom . | |

OTHER PUBLICATIONS

E. B. Trostyanskaya and G. Z. Nefedova, Vysokomolekul. Soedin "Synthesis of Insoluble Polymeric Complexones" 5, No. 1, 49–56, 1963, as abstracted in Plastics Technology, .4109, 1963.

*Primary Examiner*—T. Tung
*Attorney, Agent, or Firm*—Birch, Stewart, Kolasch & Birch

[57] ABSTRACT

A process for the production of sodium chlorate comprising electrolyzing an aqueous sodium chloride solution in a diaphragmless sodium chlorate cell, characterized in that an aqueous sodium chloride solution containing, as impurities, calcium, magnesium, barium and the like is contacted with a chelating ion exchange resin to remove the impurities and the resulting saline solution is supplied into a diaphragmless sodium chlorate cell, thereby enabling sodium chlorate to be produced at a stable electrolytic voltage. Further, there is provided a process for the production of sodium chlorate using a combination of a sodium chlorate cell and a cation exchange membrane process type chlorine-alkali cell, characterized in that a weak saline solution taken out of an anode chamber of a cation exchange membrane process type chlorine-alkali cell is supplied with sodium chloride to form an aqueous sodium chloride solution, which is subsequently contacted with a chelating ion exchange resin to remove calcium, magnesium, barium and the like contained as impurities in said solution, and at least part of the resulting purified saline solution is supplied into a sodium chlorate cell, whereby sodium chlorate formed as a by-product in the chlorine-alkali cell can be effectively recovered and the elevation of the electrolytic voltage of the sodium chlorate cell with the lapse of time can be well prevented.

9 Claims, 2 Drawing Figures

PROCESS FOR THE PRODUCTION OF SODIUM CHLORATE

Figure 1:
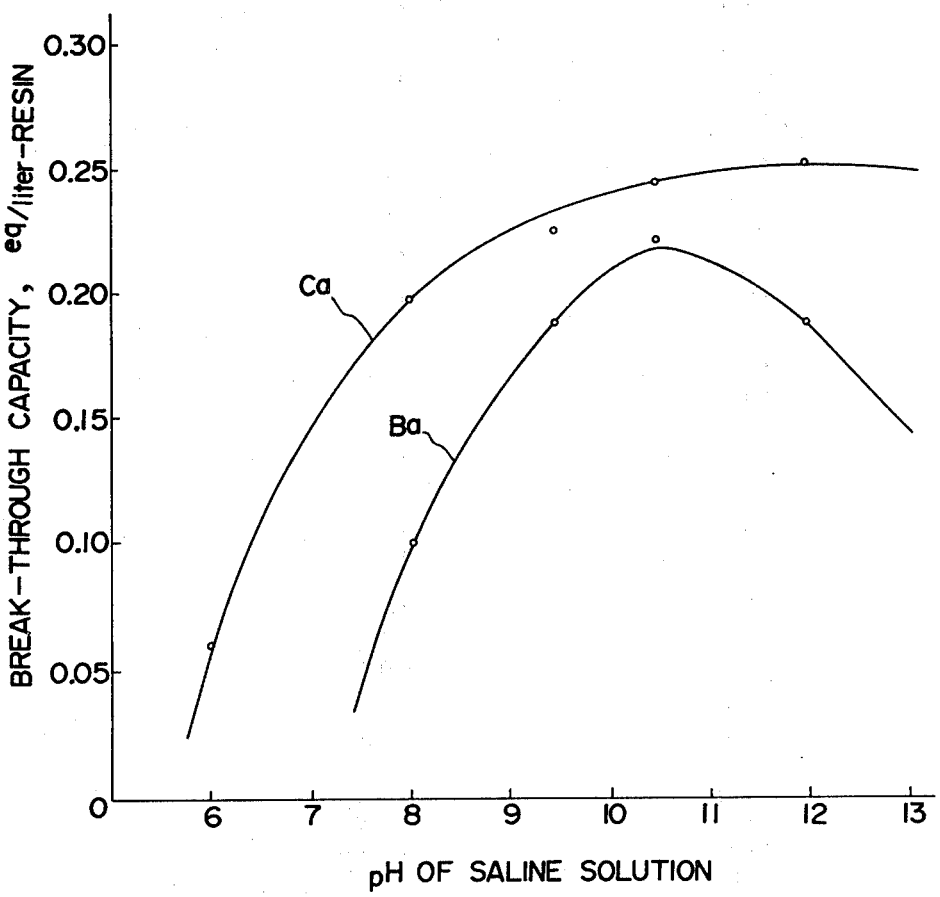

This invention relates to a process for the production of sodium chlorate by the electrolysis of an aqueous sodium chloride solution in a diaphragmless sodium chlorate cell. More particularly, the present invention, in one aspect, is concerned with a process for the production of sodium chlorate comprising electrolyzing an aqueous sodium chloride solution in a diaphragmless sodium chlorate cell, characterized in that an aqueous sodium chloride solution containing, as impurities, calcium, magnesium, barium and the like is contacted with a chelating ion exchange resin to remove the impurities and the resulting saline solution is supplied into a diaphragmless sodium chlorate cell, thereby enabling sodium chlorate to be produced at a stable electrolytic voltage. In another aspect, the present invention is concerned with an improvement in a process for the electrolysis of an aqueous sodium chloride solution comprising, in combination, a diaphragmless process for the production of sodium chlorate and a cation exchange membrane process for the production of sodium hydroxide and chlorine, said improvement being characterized in that a weak saline solution taken out of an anode chamber of an electrolytic cell for said cation exchange membrane process is supplied with crude sodium chloride to form an aqueous sodium chloride solution, which is subsequently contacted with a chelating ion exchange resin to remove calcium, magnesium, barium and the like contained as impurities in said solution, and the resulting saline solution is supplied into a diaphragmless sodium chlorate cell for said diaphragmless process, thereby enabling not only the diaphragmless process for the production of sodium chlorate but also the cation exchange membrane process for the production of sodium hydroxide and chlorine to be carried out efficiently.

In a pulp industry there are needed sodium hydroxide, chlorine, hydrochloric acid, sodium chlorate and chlorine dioxide. For this reason, a chlorine-alkali cell and a sodium chlorate cell, often are arranged in combination. On the other hand, as chlorine-alkali electrolytic production processes, there are three processes, namely, a mercury process in which a mercury cathode is employed, a diaphragm process in which a diaphragm made of a porous material such as asbestos or the like is employed and a cation exchange membrane process in which a cation exchange membrane is disposed between an anode and a cathode. Of these, the cation exchange membrane process has recently been attracting attention in the art because it has great advantages over the other two processes such that environmental pollution can be avoided and energy consumption is small. Thus, in recent years, there are many cases where a cation exchange membrane process type chlorine-alkali cell and a sodium chlorate cell are built in combination.

In general, when the electrolysis of an aqueous sodium chloride solution (hereinafter often referred to as "saline solution") is conducted in a diaphragmless sodium chlorate cell, calcium, magnesium, barium and the like contained as impurities in the saline solution are deposited on a cathode, leading to an elevation of the electrolytic voltage with the lapse of time. Conventionally, in order to remove such impurities which have an unfavorable influence on the operation of a sodium chlorate cell, sodium carbonate, sodium hydroxide and the like are added to a saline solution to be supplied into a sodium chlorate cell, so that the impurities in the saline solution are precipitation-separated as calcium carbonate, magnesium hydroxide and the like. The purified saline solution obtained by such a precipitation-separation method, however, still contains calcium and magnesium at concentrations of 3 to 20 mg/liter and 0.5 to 5 mg/liter, respectively. In this instance, if the amounts of the precipitating agents such as sodium carbonate, sodium hydroxide and the like to be added are increased, the concentrations of the remaining calcium, magnesium and the like could be lowered. However, the addition of large amounts of the precipitating agents is not preferable because not only is it uneconomical but also because it causes an excess amount of carbonate to be present in the saline solution. Furthermore, recently, a metallic anode tends to be widely used instead of a graphite anode, and accordingly, the currently employed sodium chlorate cell is operated at a current density as high as 15 $A/dm^2$ or more as opposed to the conventional sodium chlorate cell which is usually operated at 5 to 10 $A/dm^2$. As a result of this, when the saline solution purified by the conventional precipitation-separation method is used in a currently employed electrolytic cell, the impurities such as calcium, magnesium and the like remaining in the saline solution are deposited on the cathode, causing the electrolytic voltage to be elevated with the lapse of time. To avoid such an unfavorable phenomenon, a phosphate is usually added to the saline solution, which however is insufficient in effect. Therefore, at present, the adopted method is to stop the operation of the sodium chlorate cell at predetermined periods and wash the cathode with an acid.

On the other hand, because of a lack of problems with environmental pollution and small energy consumption, the chlorine-alkali production process by a cation exchange membrane process is excellent. In such a cation exchange membrane process, however, it is impossible to completely avoid reverse diffusion of hydroxyl ions from the cathode chamber to the anode chamber through the cation exchange membrane, leading to a disadvantage that sodium chlorate is formed as a by-product in the anode chamber and the sodium chlorate thus formed is accumulated in the anolyte. To avoid such an unfavorable accumulation of sodium chlorate in the anolyte, there is usually adopted a method in which expensive hydrochloric acid is added to the anolyte so as to neutralize the hydroxyl ions reverse-diffused into the anode chamber from the cathode chamber.

With respect to the arrangement of a cation exchange membrane process type chlorine-alkali cell and a sodium chlorate cell in combination, various methods have been proposed which are capable of eliminating the above-mentioned drawback of the chlorine-alkali production process of the cation exchange membrane process. For example, Japanese Patent Application Publication No. 21,400/1978 discloses a process in which a weak saline solution taken out of the anode chamber of a cation exchange membrane process type chlorine-alkali cell is supplied directly into a sodium chlorate cell. In the above-mentioned process, the sodium chlorate formed as a by-product in the anode chamber of the chlorine-alkali cell is supplied into the sodium chlorate cell together with the weak saline solution from the chlorine-alkali cell, so that the sodium chlorate is effectively recovered. In the above process, however, the concentration of sodium chloride in the saline solution supplied into the sodium chlorate cell is low and, hence, the concentration of sodium chlorate in the sodium chlorate cell cannot be increased to a sufficient level, leading to an increase not only in the load of a sodium chlorate concentrator but also in the consumption of heating steam. Further, the sulfate values contained as an impurity in the saline solution are supplied into the sodium chlorate cell after they have been concentrated in the chlorine-alkali cell, and therefore, the current efficiency of the sodium chlorate cell is lowered. In addition, according to the loads to which the chlorine-alkali cell and the sodium chlorate cell are subjected, respectively, the sodium chloride concentrations and sodium chlorate concentrations of the respective cells are varied, leading to instability of the operation.

Further, Japanese Patent Application Publication No. 37,079/1979 proposes a process in which, using an electrolytic cell having at its both ends a pair of cathodes and partitioned into a chlorate chamber, a chlorine chamber and an alkali chamber by means of a plate electrode having its both surfaces each capable of functioning as an anode and a cation exchange membrane which are disposed between said pair of cathodes, a liquid withdrawn from the chlorine chamber and a liquid withdrawn from the chlorate chamber are combined and then flowed into a chlorate concentrator and an alkali chloride concentration adjusting vessel, and the liquid from the alkali chloride concentration adjusting vessel is circulated into the chlorine chamber and the chlorate chamber. In the proposed process, the liquid from the chlorine chamber and the liquid from the chlorate chamber are mixed together and then flowed into the chlorate concentrator and, hence, the sodium chlorate formed as by-product in the chlorine chamber is effectively recovered. However, the sodium chlorate concentration of the liquid supplied into the chlorate concentrator is lowered, causing the consumption of heating steam to be increased. In addition, since the adjustment of alkali chloride concentration in the alkali chloride concentration adjusting vessel is effected in the state in which the liquid withdrawn from the chlorine chamber is mixed with the liquid withdrawn from the chlorate chamber, the liquid in the alkali chloride concentration adjusting vessel has a high chlorate concentration and, therefore, the sodium chloride concentration of the liquid in the alkali chloride concentration adjusting vessel cannot be increased to a sufficient level. As a result of this, the decomposition rates of sodium chloride in the chlorine chamber and the chlorate chamber are decreased, unfavorably leading to an increase of circulation amount. Furthermore, in the above process, the regulation with respect to production amount between chlorine, sodium hydroxide and and sodium chlorate should be inconveniently done only by controlling the intervals between the respective electrodes.

Briefly stated, according to the conventional process in which a cation exchange membrane process type chlorine-alkali cell and a sodium chlorate cell are used in combination, the effective recovery of sodium chlorate formed as a by-product in the chlorine-alkali cell gives rise to new disadvantages such as an increase in the load of a sodium chlorate concentrator, and a decrease in the decomposition rate of sodium chloride. Further, the great drawback accompanying the process for the production of sodium chlorate by the electrolysis of a saline solution containing impurities, that is, deposition of the impurities on the cathode etc., still remains unresolved.

Accordingly, it is one object of the present invention to provide a process for the production of sodium chlorate by the electrolysis of a saline solution in a diaphragmless sodium chlorate cell, which can be stably carried out without being accompanied by the elevation in electrolytic voltage of the sodium chlorate cell with the lapse of time.

It is another object of the present invention to provide a process for the production of sodium chlorate using a combination of a sodium chlorate cell and a cation exchange membrane process type chlorine-alkali cell, which can effectively recover the sodium chlorate formed as a by-product in the chlorine-alkali cell, which can be effected while maintaining a decomposition rate of sodium chloride in the sodium chlorate cell at a high level and which is capable of reducing the load of a sodium chlorate concentrator, preferably eliminating the necessity of the sodium chlorate concentrator.

Figure 2:
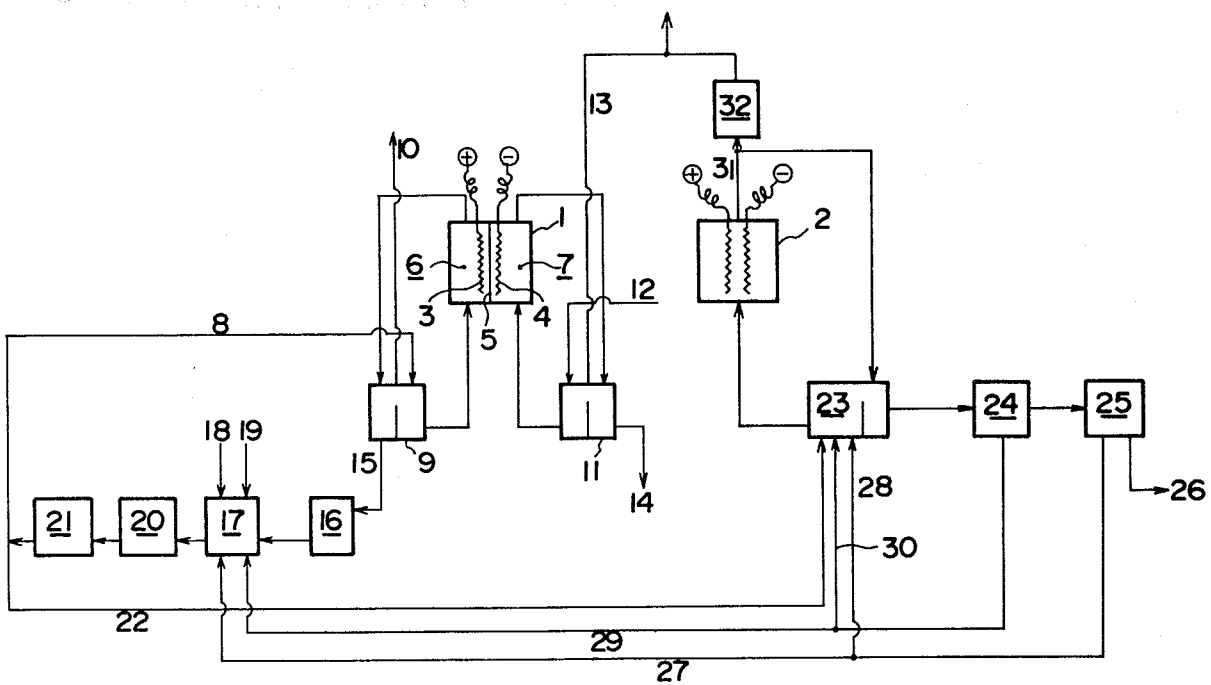

The foregoing and other objects, features and advantages of the present invention will be apparent to those skilled in the art from the following detailed description taken in connection with the accompanying drawings in which:

FIG. 1 is a graph showing the relationships respectively with respect to calcium and barium between the pH of a saline solution and the break-through capacity; and FIG. 2 is a flow sheet illustrating one mode of the process of the present invention.

Essentially and in one aspect of the present invention, there is provided a process for the production of sodium chlorate comprising electrolyzing an aqueous sodium chloride solution in a diaphragmless sodium chlorate cell, characterized in that an aqueous sodium chloride solution is contacted with a chelating ion exchange resin and the resulting saline solution is supplied into a diaphragmless sodium chlorate cell.

When a saline solution containing as impurities calcium, magnesium and barium is contacted with a chelating ion exchange resin (usually by passing through a chelating ion exchange resin column), the concentration of each of calcium, magnesium and barium in the saline solution can be reduced to 0.1 mg/liter or less, sometimes to 0.05 mg/liter by appropriately choosing the contact conditions, without causing excess carbonate values to be present. By suppressing the concentration of each of calcium, magnesium and barium in the saline solution to a level as low as 0.1 mg/liter or less, preferably 0.05 mg/liter, even when the sodium chlorate cell in which a metallic electrode is used as an anode is operated at a current density as high as 15 $A/dm^2$, the electrolytic voltage of the sodium chlorate cell can be maintained stable.

On the other hand, also in the chlorine-alkali production by the cation exchange membrane process, minute amounts of calcium and magnesium are deposited on, and/or in, the cation exchange membrane, unfavorably causing not only the current efficiency to be lowered but also the electrolytic voltage to be elevated. In order to avoid such unfavorable phenomena, the saline solution to be supplied to the cation exchange membrane process type chlorine-alkali cell is usually purified to remove impurities such as calcium, magnesium and the like so that the concentrations thereof become extremely low. Especially when a cation exchange membrane having carboxylic acid groups as the exchange groups is used, remarkable deposition of calcium and magnesium is observed. For this reason, the saline solution to be supplied to the cation exchange membrane process type chlorine-alkali cell is contacted with a chelating ion exchange resin, so that the concentration of each of calcium and magnesium in the saline solution is reduced to a level as low as 0.1 ppm or less, preferably 0.05 ppm or less, without causing excess carbonate values to be present.

Accordingly, in another aspect of the present invention, there is provided a process for the production of sodium chlorate using a combination of a sodium chlorate cell and a cation exchange membrane process type chlorine-alkali cell, characterized in that a weak saline solution taken out of an anode chamber of a cation exchange membrane process type chlorine-alkali cell is supplied with sodium chloride, and water if desired, to form an aqueous sodium chloride solution, which is subsequently contacted with a chelating ion exchange resin to remove calcium, magnesium, barium and the like contained as impurities in said solution, and at least part of the resulting purified saline solution is supplied into a sodium chlorate cell, whereby sodium chlorate formed as a by-product in the chlorine-alkali cell can be effectively recovered and the elevation of the electrolytic voltage of the sodium chlorate cell with the lapse of time can be well prevented.

The pH of a saline solution to be contacted with a chelating ion exchange resin may preferably be 8.0 or more. When the pH of a saline solution to be contacted with a chelating ion exchange resin is less than 8.0, even though the concentration of each of calcium, magnesium and the like in the saline solution after contacted with the chelating ion exchange resin is reduced to 0.05 mg/liter or less, the electrolytic voltage of the sodium chlorate cell is occasionally elevated though gradually. The reason for this is believed to be due to remaining unremoved barium. As stated before, FIG. 1 is a graph showing the relationships respectively with respect to calcium and barium between the pH of a saline solution and the break-through capacity. The chelating ion exchange resin used for making the graph of FIG. 1 is the same porous iminodiacetic acid type chelating resin as used in Example 1 which will be given later. The sodium chloride concentration of the saline solution supplied to a chelating ion exchange resin column is 300 g/liter and the temperature of the saline solution is 50° C. As is apparent from FIG. 1, when the pH of the saline solution is less than 8.0, the break-through capacity of barium is as very small as 0.10 or less eq/liter-Na type resin and, at the same time, the break-through capacity of calcium also is rapidly decreased. Therefore, barium having low selectivity cannot be sufficiently removed under the conditions where the pH of the saline solution is less than 8.0. The barium ions remaining unremoved are deposited, as barium sulfate, barium carbonate, barium hydroxide and the like, on the cathode, thereby causing the electrolytic voltage of the sodium chlorate cell to be elevated. For this reason, the pH of the saline solution may preferably be 8.0 or more, more preferably 9.5 to 12.0, within the range of which the break-through capacity of barium becomes maximum.

The temperature of the saline solution to be supplied to a chelating ion exchange resin column is not critical. But, a high temperature of the saline solution is preferred because the higher the temperature the larger the break-through capacity of the chelating ion exchange resin. The sodium chloride concentration of the saline solution is also not specifically limited, and a sodium chloride concentration as generally employed, that is 300 to 320 g/liter, may be employed.

The chelating ion exchange resin is used in the form of an Na type. After completion of the adsorbing operation, the chelating ion exchange resin is treated with a mineral acid such as hydrochloric acid to desorb the entire amount of metallic ions adsorbed on the resin, followed by treatment with a caustic soda solution to regenerate the resin as the Na type resin. The regenerated resin is provided for adsorbing operation again.

The kind of mineral acid to be used as the desorbing agent is not specifically limited. But, in the case of an acid which reacts with calcium to form a sparingly soluble salt, for example, sulfuric acid or phosphoric acid, the acid should be used in the form of a diluted solution. In addition, anions other than chlorine ion tend to be unfavorably introduced into the saline solution system. From the viewpoints of the above, it is most preferred to employ hydrochloric acid.

A series of ion exchange operations including removal of the metallic impurities from the saline solution through the adsorption by the chelating ion exchange resin, desorption of the metallic ions adsorbed on the resin and regeneration of the resin may be conducted in either a fixed bed or a moving bed according to a customary ion exchange operation.

In general, the chelating ion exchange resin is largely different in apparent volume between the free acid type resin and the regenerated Na type resin. Illustratively stated, as the free acid type ion exchange resin is exchanged with a caustic soda solution into an Na type resin, the resin is swollen, and the apparent volume of the resin which is completely regenerated into an Na type resin becomes 1.5 to 2.0 times that of the free acid type resin. For this reason, in the case of the fixed bed, the clogging of the ion exchange resin occurs at the time of regeneration of the resin due to swelling of the resin, causing passing of the liquid through the resin to be difficult and, in the case of the moving bed, it unfavorably becomes difficult to transfer the resin. In order to avoid the above-mentioned unfavorable problem, the regeneration of the resin by the treatment thereof with a caustic soda solution may be done by a rising stream in the case of the fixed bed or by a fluidized layer in the case of the fluidized bed.

On the other hand, in case the concentrations of impurities in the saline solution are large, it is economically recommended that the saline solution is subjected to a primary purification in which most of the impurities are removed by the conventional precipitation-separation method and then subjected to a secondary purification in which the resulting roughly purified saline solution is passed through the chelating ion exchange resin to obtain a highly purified saline solution.

The chelating ion exchange resin to be employed in the process of the present invention may be any of ion exchangers capable of forming an intermolecular complex by the reaction with calcium ions, magnesium ions, barium ions and/or the like. But, since the chelating ion exchange resin to be used in the process of the present invention must be reacted with minute amounts of calcium ions, magnesium ions and barium ions contained in the highly concentrated saline solution, it is preferred to employ a resin which would be reacted with above-mentioned ions at a high rate of reaction. From the above viewpoints, there may preferably be employed chelating ion exchange resins each comprising a polymer containing a functional group having a group represented by the formula $>N\text{-}CH_2COO^-$, for example, ethylenediaminetetraacetic acid, trimethylenediaminetetraacetic acid, iminodiacetic acid, aminomethylphosphonic diacetic acid or the like. With respect to the details of the above-mentioned known chelating ion exchange resins, reference may be made to, for example, U.S. Patent Specification No. 3,277,024, Japanese Patent Application Laid-Open Specification No. 22092/1977, "Synthesis Insoluble Polymer Complexones", Vysokomol. Soyed. 5 (1), 49–56 (1963), and Japanese Patent Application Laid-Open Specification No. 68900/1979.

Of the resins having the above-defined functional group, a porous iminodiacetic acid type chelating ion exchange resin formed by reacting a porous chloromethylstyrene-divinylbenzene type crosslinked copolymer with an ester of iminodiacetic acid followed by hydrolysis may most preferably be used in the process of the present invention. The skeleton of the above-mentioned porous chloromethylstyrene-divinylbenzene type crosslinked copolymer may contain units of other vinyl or vinylidene monomers than chloromethylstyrene and divinylbenzene including, for example, monovinyl or vinylidene aromatic compounds such as dichloromethylstyrene, α-chloromethylstyrene, ethylvinylbenzene and methylbenzene, acrylonitrile and esters of acrylic acid or methacrylic acid in such amounts as not to change the properties of the crosslinked copolymer. The above-mentioned porous iminodiacetic acid type chelating ion exchange resin is novel, and with respect to the preparation of the chelating ion exchange resin and the properties of the resin, reference may be made to UK Patent Application Publication No. 2,042,565 (corresponding to Japanese Patent Application Laid-Open Specification No. 106211/1980).

This porous iminodiacetic acid type chelating ion exchange resin has a swell (namely, a ratio of the volume of the Na type resin to that of the H type resin) as large as 1.40 to 1.90. When the resin has a large swell, there are caused various unfavorable phenomena, for example, clogging of the resin at the time of regeneration of the resin, decrease in strength of the resin, increase in consumed amount of the resin and the like. Therefore, it is preferred that the resin has a swell of 1.40 or less.

In short, in order for this chelating ion exchange resin to be used effectively in the process of the present invention, it is preferred that the resin not only exhibit a high rate of reaction but also have a small swell. From these viewpoints, there may preferably be employed a porous iminodiacetic acid type chelating ion exchange resin comprising as a skeleton a chloromethylstyrene-divinylbenzene type crosslinked copolymer containing 9 to 17 mol % of divinylbenzene, said resin having an ion exchange capacity of 4.2–7.2 meq/g-dry resin, a water regain of 0.6 to 2.2 ml/g-dry resin and a total volume of micro pores having a diameter ranging from 500 to 3,000 A of 0.05 to 0.60 ml/g-dry resin.

If the divinylbenzene content of the copolymer is less than 9.0 mol %, the resin tends to swell and shrink drastically, leading to decrease in strength of the resin. On the other hand, if the divinylbenzene content of the copolymer is more than 17 mol %, not only is the ion exchange capacity of the resin lowered but also the rate of reaction exhibited by the resin is decreased. The divinylbenzene content of the copolymer is more preferably 10 to 16 mol %, most preferably 11 to 15 mol %.

When the ion exchange capacity of the resin is less than 4.2 meq/g-dry resin, the number of the functional groups for forming the chelate bonding is small and accordingly, a large amount of the resin is required for practical purposes and the reaction rate is decreased. On the other hand, when the ion exchange capacity is to be more than 7.2 meq/g-dry resin, highly pure chloromethylstyrene and highly pure divinylbenzene are necessary to produce the resin, leading to increase in production cost. The more preferable ion exchange capacity is 4.8 to 6.8 meq/g-dry resin.

The water regain of the porous iminodiacetic acid type chelating ion exchange resin represents the volume of water (ml) retained in the resin when 1 g of the dry resin becomes equilibrated with water, and hence the water regain is an index of porosity of the resin in water. The water regain (represented by $W_R$) is defined by the following formula;

$$W_R=[(W_1-W_2)-0.036W_2/d]/W_2$$

wherein $W_1$ stands for a weight of the resin, having water retained therein after removal of water adhering onto its surface by centrifugation, following the establishment of equilibrium; $W_2$ for a weight of the dry resin; and d for a true density of the resin.

When the water regain of the resin is less than 0.6 ml/g-dry resin, the resin tends to swell and shrink drastically. On the other hand, when the water regain is more than 2.2 ml/g-dry resin, the strength of the resin is unfavorably decreased. The more preferable water regain is 0.20 to 1.00 ml/g-dry resin. The most preferable water regain is 0.30 to 0.90 ml/g-dry resin.

The diameter and volume of micro pores of the resin can be measured by a mercury penetration porosimeter (manufactured by Micromeritics instrument Corporation; Shimazu-Micromeritics Type Mercury Penetration Porosimeter 905-1).

When the total volume of micro pores having a diameter ranging from 500 to 3,000 A is less than 0.5 ml/g-dry resin, swelling and shrinkage of the resin become large and, in addition, the rate of reaction is decreased. When the total volume of micro pores having such a diameter as mentioned above is more than 0.60 ml/g-dry resin, the strength of the resin is decreased. The total volume of micro pores having a diameter ranging from 500 to 3,000 A is more preferably 0.10 to 0.50 ml/g-dry resin, most preferably 0.15 to 0.48 ml/g-dry resin.

The present invention will now be illustrated with reference to FIG. 2 which is a flow sheet illustrating a preferred mode of the process of the present invention. The present invention should not be limited to the mode of FIG. 2 in which a sodium chlorate cell and a cation exchange membrane process type chlorine-alkali cell are arranged in combination.

In FIG. 2, numeral 1 designates a chlorine-alkali cell and numeral 2 a sodium chlorate cell. The chlorine-alkali cell 1 is partitioned into an anode chamber 6 and a cathode chamber 7 by means of a cation exchange membrane 5 disposed between an anode 3 and a cathode 4. A purified saline solution which is supplied to an anolyte circulating tank 9 through a line 8 is subjected to electrolysis while being circulated between the anolyte circulating tank 9 and the anode chamber 6. Chlorine gas generated in the anode chamber 6 is withdrawn from a line 10. Numeral 11 designates a catholyte circulating tank to which water is supplied through a line 12 according to necessity. A catholyte is subjected to electrolysis while being circulated between the catholyte circulating tank 11 and the cathode chamber 7. Hydrogen gas and an aqueous sodium hydroxide solution produced are withdrawn from a line 13 and a line 14, respectively.

A weak saline solution having a decreased sodium chloride concentration as a result of the electrolysis is withdrawn from a line 15 and then adjusted with respect to pH if desired. The weak saline solution is subjected to dechlorination treatment in a dechlorinating tower 16 and then supplied to a sodium chloride dissolving vessel 17. A crude saline solution obtained by feeding water 18 and sodium chloride 19 to the weak saline solution in the sodium chloride dissolving vessel 17 is supplied to a primary purification apparatus 20 and then to a secondary purification apparatus 21. In both the apparatuses 20 and 21, the crude saline solution is highly purified to remove impurities such as calcium, magnesium and the like and then recycled to the anolyte circulating tank 9 through the line 8. In the primary purification apparatus 20, precipitating agents such as sodium carbonate, barium carbonate, barium chloride, calcium chloride, sodium hydroxide, calcium hydroxide and the like are added to the crude saline solution to remove calcium, magnesium and sulfate values and the like in the form of precipitates of calcium carbonate, magnesium hydroxide, barium sulfate, calcium sulfate and the like. The secondary purification apparatus 21 comprises a chelating ion exchange resin column. By passing the roughly purified saline solution obtained by the primary purification apparatus through the resin column, calcium, magnesium, barium and heavy metals remaining unremoved in the roughly purified saline solution are removed with further completeness. In the above-mentioned procedures, when impurity-free sodium chloride such as crystallized sodium chloride is added in the sodium chloride dissolving vessel 17, the primary purification apparatus 20 may be omitted.

Part of the highly purified saline solution from the secondary purification apparatus is supplied to a residence tank 23 or the sodium chlorate cell 2 through a line 22. The electrolyte is circulated between the sodium chlorate cell and the residence tank. Part of the electrolyte is withdrawn from the residence tank 23 and then supplied, through a sodium chlorate concentrator 24 in which the sodium chlorate concentration is increased, to a crystallizer 25 where sodium chlorate is crystallized out. The sodium chlorate thus crystallized out is withdrawn through a line 26. A mother liquor obtained by the crystallization-out of sodium chlorate may be either supplied to the sodium chloride dissolving vessel 17 through a line 27 or recycled to the residence tank 23 through a line 28, but it is rather preferable to supply the mother liquor to the sodium chloride dissolving vessel 17 because the sodium chlorate concentration of the electrolyte can be increased. Sodium chloride deposition-separated in the sodium chlorate concentrator may be either supplied to the sodium chloride dissolving vessel 17 through a line 29 or recycled to the residence tank 23 through a line 30. In this connection, it is noted that such sodium chloride thus deposition-separated may preferably be used as a solid sodium chloride to be fed to the sodium chloride dissolving vessel 17 in order to adjust the sodium chloride concentration of the weak saline solution, when a well brine is used as a raw sodium chloride material for the present process. Hydrogen gas formed is taken out of the sodium chlorate cell 2 through a line 31 and a minute amount of chlorine gas contained in the hydrogen gas is removed in a scrubbing column 32, whereupon the resulting hydrogen gas and the hydrogen gas from the chlorine-alkali cell are combined and then withdrawn together.

In the chlorine-alkali production, the flow of the saline solution forms a circulation route of anolyte circulating tank 9→dechlorinating tower 16→sodium chloride dissolving vessel 17→primary purification apparatus 20→secondary purification apparatus→anolyte circulating tank. It is important that the saline solution to be supplied to the sodium chlorate cell comes from the above route at its point immediately after the secondary purification apparatus. Only by doing so, not only the sodium chlorate formed as a by-product in the chlorine-alkali cell can be effectively recovered through the sodium chlorate cell, but also there are brought about such various advantages such as the elevation of the electrolytic voltage of the sodium chlorate cell with the lapse of time is well prevented, the electrolysis can be conducted with high current efficiency, and the sodium chlorate concentration in the electrolyte of the sodium chlorate cell can be increased, leading to a decrease in the consumption of heating steam in the sodium chlorate concentrator. A further advantage is that since the amount of saline solution to be supplied to the chlorine-alkali cell through the line 8 can be determined independently of the amount of saline solution to be supplied to the sodium chlorate cell through the line 22, the respective loads of both of the electrolysis systems can be freely controlled without changing the decomposition rate of saline solution.

If the saline solution is taken out of the anolyte circulating tank 9 and supplied to the sodium chlorate cell through a line branched from the line 15, the supplied solution has not only a sodium chloride concentration lowered due to the electrolysis in the chlorine-alkali cell but also a sulfate concentration increased due to the movement of water from the anode chamber to the cathode chamber through the cation exchange membrane. Therefore, not only cannot the sodium chlorate concentration in the electrolyte of the sodium chlorate cell be increased, but also the current efficiency for the formation of sodium chlorate is lowered. Further, if the saline solution is taken out of the above-mentioned route at the point immediately after the sodium chloride dissolving vessel 17 or the first purification apparatus 20, since calcium and magnesium in the saline solution are not sufficiently removed, this will cause the electrolytic voltage of the sodium chlorate to be elevated with the lapse of time.

The process of the present invention is extremely effective, especially when the sodium chlorate cell having a metallic anode provided therein is operated at a current density as high as 15 $A/dm^2$ or more. As the metallic anode, an electrode comprising a titanium substrate and a coating of at least one of the platinum group metals or an alloy, oxide or oxygen-containing solid solution thereof applied onto said substrate may be used without any restriction. As a cathode, an electrode made of a metal such as iron, stainless steel or titanium or comprising such metals and a platinum group metal or alkaline earth metal-containing coating applied thereonto may be used without any restriction. The type of an electrolytic cell may be of either monopolar arrangement or bipolar arrangement.

The composition of the electrolyte of the sodium chlorate cell may be controlled within such conditions that the sodium chlorate concentration is 300 to 650 g/liter and the sodium chloride concentration is 70 to 200 g/liter. When the sodium chlorate concentration is as high as possible, the load of the sodium chlorate concentrator become advantageously small. The preferred composition is such that the sodium chlorate concentration is 500 to 650 g/liter and the sodium chloride concentration is 70 to 120 g/liter. When sodium dichromate is added to the electrolyte at a concentration of 2 to 4 g/liter, cathodic reduction of hypochlorite ions can be well prevented. The pH of the electrolyte and the temperature of the electrolyte may be controlled within the range of 6.0 to 7.0 and within the range of 60° to 90° C., respectively. The current density may be 10 to 50 A/dm$^2$.

The type of the chlorine-alkali cell to be arranged in combination with the sodium chlorate cell may be of either monopolar arrangement or bipolar arrangement. The material of the cell may be either a metal or a plastic material. As an anode, an electrode comprising a titanium substrate and a coating of at least one of the platinum group metals or an oxide, or oxygen-containing solid solution thereof applied thereonto is preferred. As a cathode, there may preferably be employed an electrode made of iron or nickel or comprised of such a metal as the substrate and a coating of nickel rhodanide or Raney nickel applied thereonto. The kind of cation exchange membrane to be employed in the chlorine-alkali cell is not critical. However, from a viewpoint of resistance to chlorine, there may preferably be employed a cation exchange membrane made of a fluorocarbon type resin. The current efficiency of the cation exchange membrane for the formation of sodium hydroxide is necessarily 80% or more, preferably 90% or more. When the current efficiency of the cation exchange membrane is low, the amount of sodium chlorate formed as a by-product is increased and, hence, the sodium chlorate concentration in the saline solution becomes high, leading to not only difficultly in dissolving the sodium chloride in the saline solution but also increase in generation of oxygen gas on the anode. A cation exchange membrane having carboxylic acid groups on its at least one surface on the side of the cathode exhibits a high current efficiency and, therefore, is preferably employed.

The sodium hydroxide concentration in the catholyte of the chlorine-alkali cell may be within the range of 15 to 45% by weight. Under such conditions, the chlorine-alkali cell can be operated. The sodium hydroxide concentration may be controlled by the amount of water to be fed to the catholyte circulating tank.

The sodium chloride concentration in the anolyte of the chlorine-alkali cell may be within the range of 100 to 300 g/liter. Under such conditions, the chlorine-alkali cell can be operated. The sodium chloride concentration may be controlled by the amount of the highly purified saline solution to be fed to the anolyte circulating tank. When the sodium chloride concentration is too low, the electrolytic voltage is elevated. When the sodium chloride concentration is too high, the sodium chloride content of the sodium hydroxide produced in the cathode chamber is unfavorably increased. The more preferable sodium chloride concentration is 130 to 230 g/liter.

It is noted that the sodium chloride concentration in the highly purified saline solution to be fed to the anolyte circulating tank is preferably as high as possible because the decomposition rate of sodium chloride is high at a high concentration of sodium chloride. The sodium chloride concentration in the highly purified saline solution may be 270 g/liter or more, preferably 300 g/liter or more. The sodium chlorate concentration is determined depending on the amount of sodium chlorate formed as a by-product in the chlorine-alkali cell and the amount of the highly purified saline solution to be fed to the sodium chlorate cell through the branched line, but is usually 10 to 100 g/liter. It is necessary to reduce the amounts of impurities such as calcium, magnesium, iron, sulfate values to a level as low as possible. The concentration of each of calcium, magnesium and iron should be 0.1 ppm or less, preferably 0.05 ppm or less. The concentration of sulfate values should be 5 g/liter or less, preferably 1 g/liter or less. When the concentration of sulfate groups is high, the current efficiency of the sodium chlorate cell is lowered.

The electrolysis temperature of the chlorine-alkali cell may be 50° to 100° C., preferably 70° to 90° C. The current density may be 15 to 70 A/dm$^2$, preferably 20 to 50 A/dm$^2$.

As described, according to the process of the present invention, the concentration of each of calcium, magnesium, barium and the like contained as impurities in the saline solution to be supplied to the sodium chlorate cell is extremely low and an excess amount of carbonate values is not present therein. Therefore, during the operation of the sodium chlorate cell, not only the above-mentioned impurities are well prevented from depositing on the cathode and hence the elevation of the electrolytic voltage of the sodium chlorate cell with the lapse of time is avoided, but also it is no longer necessary to add a phosphate to the electrolyte or to stop the operation of the sodium chlorate cell at predetermined intervals and wash the cathode with an acid. Accordingly, the operation becomes easy to administer and the working efficiency is also enhanced. Further, it should be noted that the current efficiency for the formation of the sodium chlorate is increased. The reason for such an increase in current efficiency is believed to be as follows: in the saline solution are contained small amounts of heavy metal ions such as ions, nickel, cobalt and copper ions as a decomposition catalyst for sodium hypochlorite which is formed as an intermediate for the formation of sodium chlorate. The amounts of such heavy metal ions in the saline solution are reduced to a level as low as 0.05 mg/liter or less by passing the saline solution through a chelating ion exchange resin column.

Furthermore, in the combined arrangement of a sodium chlorate cell and a chlorine-alkali cell, not only can sodium chlorate formed as a by-product in the chlorine-alkali cell be effectively recovered, but also the sodium chlorate concentration in the electrolyte of the sodium chlorate cell can be increased and hence the load of the sodium chlorate concentrator can be decreased.

The following Examples are given for illustration of the present invention in more detail, but should not be construed to be limiting the scope of the present invention.

EXAMPLE 1 and COMPARATIVE EXAMPLE 1

Two ion exchange columns were installed which were filled with a porous iminodiacetic acid type chelating ion exchange resin which had been prepared by reacting a chloromethylstyrene-divinylbenzene type cross-linked copolymer having 12.5 mol % of divinylbenzene monomer units with ethyl iminodiacetate and which had an exchange capacity of 5.41 meq/g-dry rein, a water regain of 1.21 ml/g-dry resin, a total volume, of micropores of 500 A to 3,000 A in diameter, of 0.40 ml/g-dry resin and a swell of 1.38. To one of the ion exchange columns was continuously fed a saline solution roughly purified by the conventional precipitation-separation method. Every 24 hours (one day), the feeding of the saline solution was alternately switched from the one column to the other column. The resin filled in the column on which the adsorption operation had been completed was washed with 2 N hydrochloric acid to elute and remove impurities adsorbed on the resin, and fed with 2 wt % caustic soda solution to regenerate the resin as the Na type resin. By repeating the above procedure, a purified saline solution was continuously prepared. The saline solution roughly purified by the conventional precipitation-separation method had a sodium chloride concentration of 300 g/liter, a calcium ion concentration of 10–20 mg/liter, a magnesium ion concentration of 1–3 mg/liter, a barium ion concentration of 0.5–1.0 mg/liter, an iron ion concentration of 0.1–0.5 mg/liter and a pH value of 10, whereas the saline solution purified by passing the roughly purified saline solution through one of the ion exchange columns had such a decreased impurity concentration that all the concentrations of calcium ions, magnesium ions, barium ions and iron ions were each less than 0.05 mg/liter.

The purified saline solution thus prepared was continuously fed into a diaphragmless sodium chlorate cell including a ruthenium oxide-coated titanium anode and an iron cathode, and subjected to electrolysis under the following conditions which was continued for 500 hours.

Electrolysis Conditions current density: 25 A/dm$^2$
electrolysis temperature: 85° C.
pH: 6.5

The electrolytic voltage was stable at 3.20 V through the electrolysis and showed no increase with the lapse of time. The current efficiency was 96% as regards the formation of sodium chlorate.

For the purpose of comparison, the saline solution roughly purified by the conventional precipitation-separation method but not purified by the above-mentioned ion exchange procedure was fed into the same electrolytic cell as employed above, and subjected to electrolysis under the same conditions as adopted above. The electrolytic voltage was 3.20 V at the initial stage of the electrolysis but increased to 3.35 V 200 hours after the start of the electrolysis. The current efficiency was 95% as regards the formation of sodium chlorate.

EXAMPLE 2

Using a porous iminodiacetic acid type chelating ion exchange resin which had been prepared by reacting a chloromethylstyrene-divinylbenzene type cross-linked copolymer having 14.7 mol % of divinylbenzene monomer units with ethyl iminodiacetate and which had an exchange capacity of 4.60 meq/g-dry resin, a water regain of 0.75 ml/g-dry resin, a total volume, of micropores of 500 A to 3,000 A in diameter, of 0.20 ml/g-dry resin and a swell of 1.27, saline solutions, which were prepared by adjusting a saline solution roughly purified by the conventional precipitation-separation method and as employed in Example 1 to have varied pH values, i.e. 6.0, 7.0, 8.0, 9.0, 11.0, 12.0 and 13.0, were purified, and subjected to electrolysis in substantially the same manner as in Example 1.

The concentrations of impurities in the saline solutions purified by the above-mentioned ion exchange procedure were listed together with the electrolysis voltages just after the start of electricity supply to the cell and 500 hours thereafter in Table 1.

TABLE 1

| | Impurity Concentration (mg/l) | | | | Voltage (V) | |
|---|---|---|---|---|---|---|
| pH | Ca ions | Mg ions | Ba ions | Fe ions | just after start | 500 hours |
| 6.0 | <0.05 | <0.05 | 0.6 | <0.05 | 3.20 | 3.35 |
| 7.0 | <0.05 | <0.05 | 0.2 | <0.05 | 3.20 | 3.31 |
| 8.0 | <0.05 | <0.05 | 0.05 | <0.05 | 3.20 | 3.21 |
| 9.0 | <0.05 | <0.05 | <0.05 | <0.05 | 3.20 | 3.20 |
| 11.0 | <0.05 | <0.05 | <0.05 | <0.05 | 3.20 | 3.20 |
| 12.0 | <0.05 | <0.05 | <0.05 | <0.05 | 3.20 | 3.20 |
| 13.0 | <0.05 | 0.10 | 0.05 | 0.10 | 3.20 | 3.23 |

It is apparent from Table 1 that substantially no change in electrolytic voltage is observed in the case of saline solutions having a pH value of 8.0 or more while a slight increase in electrolytic voltage is observed in the case of saline solutions having a pH value of 7.0 or less.

The porous iminodiacetic acid type chelating ion exchange resins used in Examples 1 and 2 were respectively prepared in substantially the same manner as described in Example 6 and Example 8 of Japanese Patent Application Laid-Open Specification No. 106211/1980 corresponding to GB Pat. No. 2,042,565.

EXAMPLE 3

The production of chlorine gas, sodium hydroxide, hydrogen gas and sodium chlorate was carried out according to a combined system as shown in FIG. 2.

An expanded metal anode of titanium coated with an oxygen-containing solid solution of ruthenium, titanium and zirconium was welded, through the medium of a titanium rib, with the titanium surface of a composite titanium-iron plate produced by explosive pressure-adhesion, and an expanded metal cathode of soft steel was welded, through the medium of an iron rib, with the iron surface of the composite titanium-iron plate to produce a bipolar type unit cell.

A number of bipolar type unit cells as produced above were arranged and clamped by means of a filter press to make a diaphragmless sodium chlorate cell. On the other hand, a number of bipoler type unit cells and a number of cation exchange membranes were arranged in alternate order, and clamped by means of a filter press to make a cation exchange membrane process type chlorine-alkali cell. The cation exchange membranes were made of a fluorocarbon resin as the base polymer and had carboxylic groups on the cathode side and sulfonic groups on the anode side.

The chlorine-alkali cell was operated at an electrolysis temperature of 90° C. and at a current density of 40 A/dm$^2$ to produce 1 ton/hour of sodium hydroxide. The amount of water being fed to a catholyte circulating tank was controlled to adjust the sodium hydroxide concentration of a catholyte to 21 wt%. The amount of a purified saline solution with a sodium chloride concentration of 310 g/liter being fed to an anolyte circulating tank was controlled to adjust the sodium chloride concentration of an anolyte to 175 g/liter. The current efficiency was 95% as regards the formation of sodium hydroxide. Chlorine gas was produced at a rate of 0.89 ton/hour. The voltage was stable at 3.60 V through the electrolysis.

A saline solution subjected to the so-called primary purification had a sodium chloride concentration of 310 g/liter, a sulfate value concentration of 1 g/liter, a calcium ion concentration of 5–15 mg/liter, a magnesium ion concentration of 1–5 mg/liter and a barium ion concentration of 0.5–1.0 mg/liter. The calcium, magnesium and barium ions in the above-mentioned saline solution were so removed by means of a porous iminodiacetic acid group-containing styrene-divinylbenzene type chelating ion exchange resin to effect the secondary purification that the concentrations of calcium ions, magnesium ions and barium ions were each less than 0.05 mg/liter. The porous iminodiacetic acid type chelating ion exchange resin used as DIAION CR-10 (trade name of a product manufactured by Mitsubishi Kasei K.K., Japan). Part of the saline solution subjected to the secondary purification was supplied to the sodium chlorate electrolytic system to form a solution with a sodium chlorate concentration of 15–20 g/liter.

The diaphragmless sodium chlorate cell was operated at an electrolysis temperature of 80° C. and a current density of 25 A/dm$^2$ to produce 0.5 ton/hour of sodium chlorate. An electrolyte was adjusted to have a sodium chlorate concentration of 550–600 g/liter, a sodium chloride concentration of 80–100 g/liter and a pH value of 6.5. Sodium dichromate was added to the electrolyte so as to provide a sodium dichromate concentration of 2–4 g/liter. Part of the saline solution subjected to the secondary purification was supplied to a residence tank, and sodium chloride deposition-separated in a sodium chlorate concentrator and a mother liquor obtained after the crystallization-out of sodium chlorate were recycled into the residence tank.

The current efficiency was 96% as regards the formation of sodium chlorate. The voltage was stable at 3.20 V through the electrolysis.

Comparative Example 2

In substantially the same manner as in Example 3 except that a weak saline solution with a sodium chloride concentration of 175 g/liter was supplied through a line branched from a line 15 to a diaphragmless sodium chlorate cell, electrolysis was carried out. The sodium chlorate concentration of an electrolyte in the sodium chlorate cell was 200–250 g/liter. The current efficiency was 94% as regards the formation of sodium chlorate.

In substantially the same manner as in Example 3 except that a saline solution subjected to the primary purification and as used in Example 3 was supplied to the sodium chlorate cell, electrolysis was carried out. The sodium chlorate concentration of an electrolyte in the sodium chlorate cell was as high as 550–600 g/liter. The electrolytic voltage was 3.20 V at the initial stage of the electrolysis, but increased to 3.35 V 200 hours after the start of the electrolysis.

What is claimed is:

1. In a process for the electrolysis of an aqueous sodium chloride solution which comprises, in combination, a diaphragmless process for the production of sodium chlorate using a sodium chlorate cell and a cation exchange membrane process for the production of sodium hydroxide and chlorine using a chlorine-alkali cell partitioned by means of a cation exchange membrane into a anode chamber and a cathode chamber, and wherein a weak saline solution taken out of the anode chamber of the chlorine-alkali cell is fed into the sodium chlorate cell, the improvement which comprises supplying sodium chloride to the weak saline solution taken out of the anode chamber of the chlorine-alkali cell to form an aqueous sodium chloride solution which is subsequently contacted with a porous iminodiacetic acid type chelating ion exchange resin comprising as a skeleton a chloromethylstyrene-divinylbenzene type crosslinked copolymer containing 9 to 17 mole % of divinylbenzene, said resin having an ion exchange capacity of 4.2–7.2 meq/g-dry resin, a water regain of 0.6 to 2.2 ml/g-dry resin and a total volume of micro pores having a diameter ranging from 500 to 3,000 A of 0.05 to 0.60 ml/g-dry resin, at a pH of 8.0 or more to remove impurities contained in said aqueous sodium chloride solution to an extent that the amounts of Ca, Mg and Ba ions in the resulting saline solution are 0.1 mg/liter or less, and at least part of the resulting saline solution is fed into the sodium chlorate cell, thereby enabling sodium chlorate to be produced at high concentration and at a stable electrolytic voltage.

2. A process according to claim 1, wherein the pH is 9.5 to 12.0.

3. A process according to claim 1, wherein said saline solution has a sodium chloride concentration of 270 g/liter or more.

4. A process according to claim 7, wherein said saline solution has a sodium chloride concentration of 300 to 320 g/liter.

5. A process according to claim 1, wherein said chlorine-alkali cell is fed with a purified aqueous sodium chloride solution obtained by contacting a crude aqueous sodium chloride solution with a chelating ion exchange resin.

6. A process according to claim 1, wherein said aqueous chloride solution is first subjected to a primary purification comprising a precipitation-separation process and then subsequently contacted with said chelating ion exchange resin.

7. A process according to claim 1, wherein said chelating ion exchange resin has a swell, defined by the ratio of the volume of the Na-type resin to that of the H-type resin, of 1.40 or less.

8. A process according to claim 1, wherein said sodium chlorate cell is operated at a current density of 15 A/dm$^2$ or more.

9. A process according to claim 1, wherein the amounts of Ca, Mg, and Ba ions in said resulting saline solution after contacting said chelating ion exchange resin are 0.005 mg/l or less.

* * * * *

UNITED STATES PATENT AND TRADEMARK OFFICE

CERTIFICATE OF CORRECTION

PATENT NO. : 4,405,418

DATED : September 20, 1983

INVENTOR(S) : Reiji TAKEMURA

It is certified that error appears in the above-identified patent and that said Letters Patent are hereby corrected as shown below:

On the title page:

In the category "[30] Foreign Application Priority Data" change "55-2533" to --55-25233--.

Signed and Sealed this

Thirteenth Day of December 1983

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,405,418

DATED : September 20, 1983

INVENTOR(S) : Reiji TAKEMURA

It is certified that error appears in the above-identified patent and that said Letters Patent are hereby corrected as shown below:

Column 16

Claim 1

Line 30, after "and" insert --feeding--;

after "solution" delete "is",

Line 31, delete "fed".

Signed and Sealed this

Seventeenth Day of April 1984

[SEAL]

*Attest:*

GERALD J. MOSSINGHOFF

*Attesting Officer*

*Commissioner of Patents and Trademarks*